United States Patent [19]

Ganek et al.

[11] Patent Number: 4,493,974

[45] Date of Patent: Jan. 15, 1985

[54] SNAP-FIT SHEET METAL COVER FOR PORTABLE OIL-FILLED RADIATORS AND METHOD OF MANUFACTURE

[75] Inventors: Jerome S. Ganek, Downers Grove; Lee G. Ganek, St. Charles, both of Ill.

[73] Assignee: Ciracco Metal Fabricating Co., Inc., Countryside, Ill.

[21] Appl. No.: 457,021

[22] Filed: Jan. 12, 1983

[51] Int. Cl.[3] ..... F24H 7/02; F24H 9/02

[52] U.S. Cl. ..... 219/341; 165/129; 219/365; 219/366; 239/79

[58] Field of Search ..... 219/341, 365, 362, 366–368; 165/129; 237/79

[56] References Cited

U.S. PATENT DOCUMENTS

| | | | |
|---|---|---|---|
| 1,174,626 | 3/1916 | Shipp | 237/79 X |
| 1,345,591 | 7/1920 | Fulton | 165/129 |
| 1,600,979 | 9/1926 | Denning | 237/79 |
| 1,628,774 | 5/1927 | Guillemet | 237/79 X |
| 1,777,241 | 9/1930 | Young | 237/79 X |
| 1,856,454 | 5/1932 | Bacon | 165/129 |
| 1,945,815 | 2/1934 | Landerman | 219/362 X |
| 2,480,809 | 8/1949 | Freyman | 219/341 |
| 2,521,173 | 9/1950 | Koral | 219/341 |

FOREIGN PATENT DOCUMENTS

| | | | |
|---|---|---|---|
| 193512 | 11/1957 | Austria | 219/341 |
| 504532 | 7/1954 | Canada | 165/129 |
| 1037103 | 8/1958 | Fed. Rep. of Germany | 219/341 |

OTHER PUBLICATIONS

"Oil Filled Electric Radiator–Model #5108, Contempo", by DeLonghi, America, New York, N.Y. 10118.

"Dimplex Electric Area Heater", Dimplex Inc., Stamford, Conn., 06903.

"City Radiator Cabinets", Ciracco Metal Fabricating Co., Countryside, Ill., 60525.

*Primary Examiner*—A. Bartis

*Attorney, Agent, or Firm*—Charles F. Meroni, Jr.

[57] ABSTRACT

An oil filled electric radiator supporting structure is provided having a supporting frame structure including castors supporting the same. An oil filled electric radiator is mounted in supported assembly on the frame structure. Means is provided securing the radiator to the frame structure. A radiator control panel is positioned at one end of the radiator. A radiator cover structure is mounted on the radiator and fitted about the control panel, the cover structure being provided with a cover comprised of cold rolled steel having a thickness in the range of 0.033"–0.038". The cover further includes downwardly extending parallel sides on opposite sides of the radiator for permitting air flow to circulate to and from the radiator and with one of the sides being perforated. The sides are provided with yieldable confronting converging bottom ends extending beneath the radiator on its opposite sides. The bottom ends are spaced apart a distance narrower than the width of the radiator so as to yieldably engage against the sides of the radiator for holding the cover and its sides in snug assembly with the radiator and its frame structure and with the bottom ends of the sides also bodily engaged against the frame structure to support the cover on the frame structure.

13 Claims, 10 Drawing Figures

FIG. 1
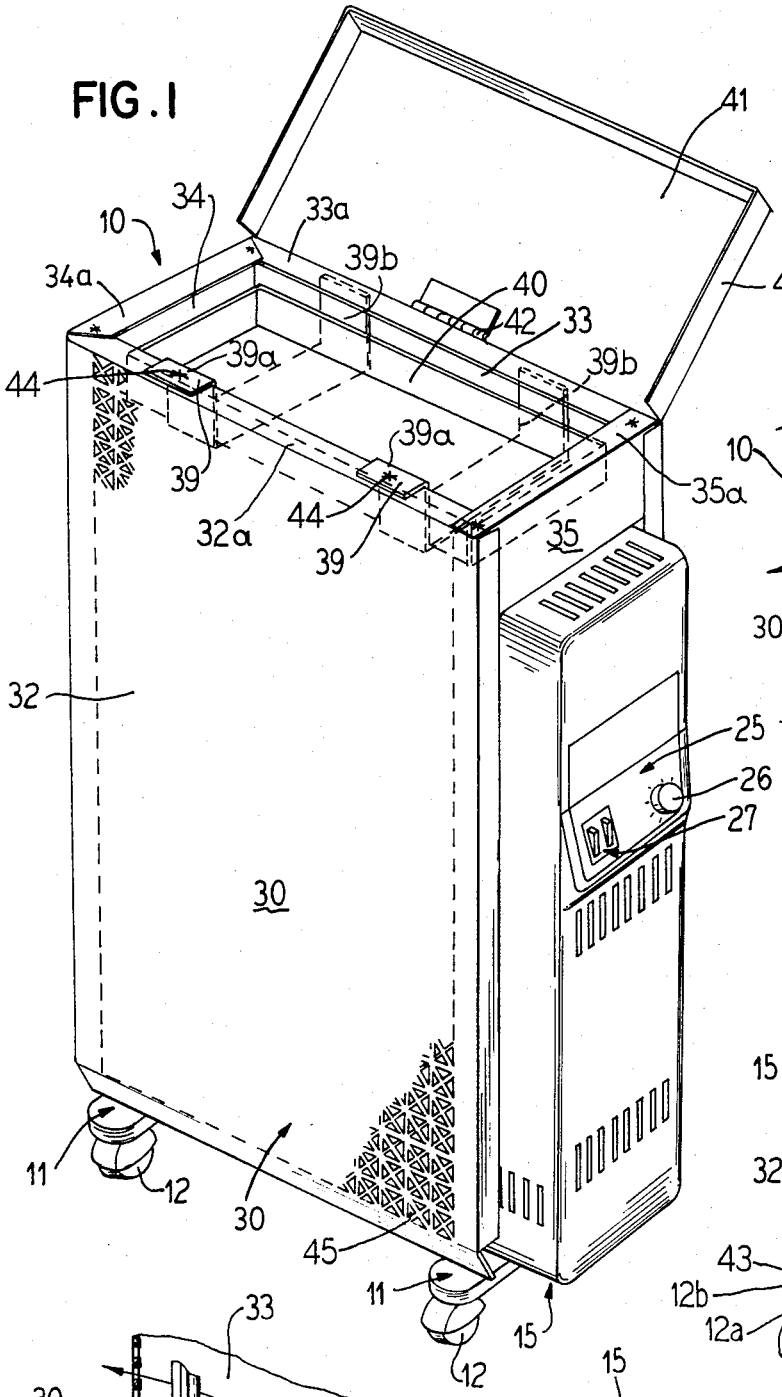
FIG. 2
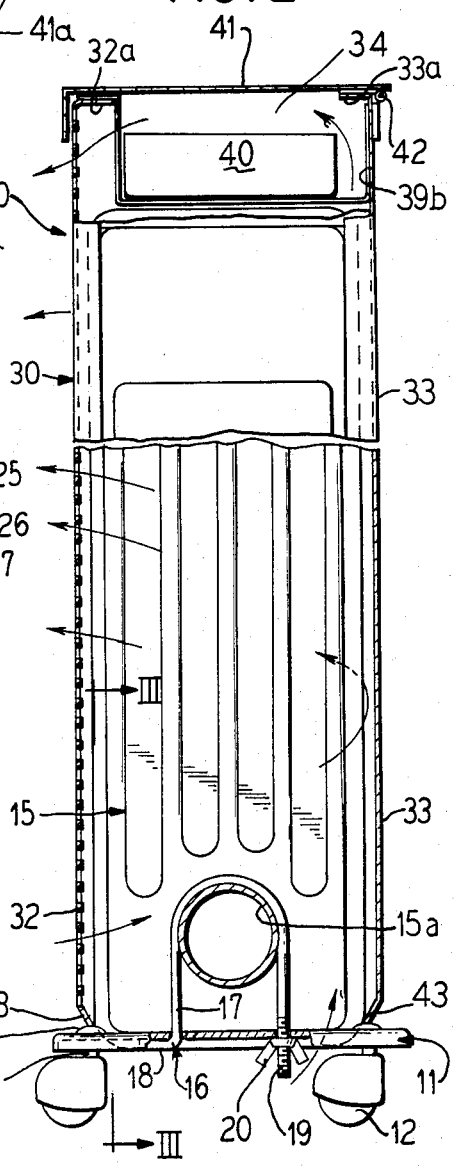
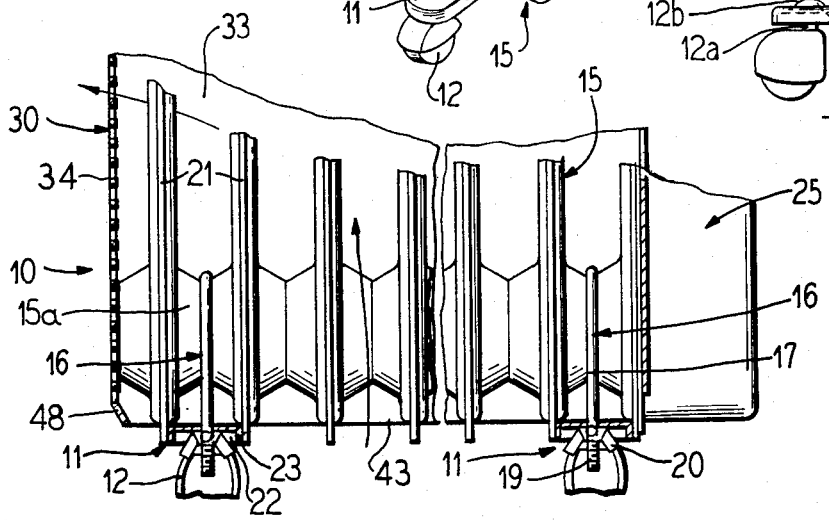
FIG. 3

SNAP-FIT SHEET METAL COVER FOR PORTABLE OIL-FILLED RADIATORS AND METHOD OF MANUFACTURE

This invention relates to a new combination of a portable electric oil filled radiator and a cover structure, whereby the safety and efficiency of the radiator is improved. The invention also relates to a new method of manufacture of a cover structure for a portable oil filled radiator. By enclosing the radiator with a solid back and top, the circulation of the warmed air is much more efficient than the undirected flow of air over conventional uncovered portable radiators, also, eliminating the need of keeping the heater in the center of the room for 360 degree benefit of heat. With the radiator enclosed in this cover, it can be placed against a wall and function more efficiently and also be much safer for protecting children and others from being burned or injured by uncovered sharp, hot radiator fins.

Prior Art—Relating to Electric Radiators

Electric radiators work basically the same as hot water radiators, with the exception that the source of heat is electricity as opposed to heat from a boiler, and also, the electric radiator is portable, as opposed to stationary, builtin prior art type radiators. This creates a situation different from that which has been existent in the art in the past.

The radiator covers previously used on hot water radiators have been heavy, freestanding, bulky and expensive. The state of the art radiator cabinets cannot be used with the smaller electric radiators because of their bulk and weight. Also, the basic freestanding prior art radiator cabinet would have to be modified to be mounted on a portable radiator, which would create a more complicated method of manufacture.

The previous methods for manufacturing have been, basically, to assemble back, assemble sides, assemble front, and then assemble all components with a top and bracket which would be a very time consuming, and expensive method of manufacture, thereby creating an enclosure that would be too bulky to be feasable.

SUMMARY OF THE INVENTION

The present invention embodies all of the benefits of the state of the art radiator enclosures, while being small, light-weight and constructed so as to have a snap fit for new electric radiators now on the market. By employing the process of spot perforating a single sheet of steel, the complete cabinet body unit or cover structure can be formed by a new method of manufacture in a series of single operations without the necessity of bulky assemblies and extraneous parts, and the unit can be slipped over the radiator with a minimum of effort. The addition of a water pan in the top of the cabinet or cover structure serves to raise room humidity and to make a room much more comfortable.

In view of the foregoing discussion it will now be appreciated that it is an important object of this invention to provide a ventilated cover structure for an oil filled electric radiator which can be economically manufactured on a large production basis and which can be readily mounted upon the radiator for attractively ornamenting the same.

Still another important object of this invention is to provide a new and improved combination including an oil filled electric radiator structure and a radiator cover structure mounted thereon which components can be conveniently assembled with a minimum of effort and where the radiator cover structure has a water reservoir overlying the portable oil filled electric radiator structure to serve as a room humidifier.

Yet another and still further object of this invention is to provide a new and improved method for making a radiator cover structure for use with a portable oil filled electric radiator.

An important feature of this invention is to provide a new and improved combination, which combination includes an oil filled electric radiator mounted in supported assembly on the frame structure, means securing the radiator to said frame structure, a radiator control panel at one end of said radiator, and a radiator cover structure mounted on the radiator and fitted about said control panel, the cover structure having a cover comprised of cold rolled steel having a thickness in the range of 0.033"–0.038", the cover including downwardly extending parallel sides on opposite sides of the radiator for permitting air flow to circulate to and from the radiator, one of said sides being perforated, the sides having yieldable confronting converging bottom ends extended beneath said radiator on its opposite sides, the bottom ends being spaced apart a distance narrower than the width of the radiator so as to yieldably engage against the sides of the radiator for holding the cover and its sides in snug assembly with the radiator and its frame structure and with said bottom ends of the sides also bodily engaged against said frame structure to support the cover on said frame structure.

A further feature concerns the provision of a cover having opposite sides with converging bottom ends or flanges having an angle in the range of 39°–50° for placement in underlying relation with respect to radiator fins.

A still further feature of this invention is to provide a combination where the cover panel has opposite panel ends, one of the panel ends and the sides being formed from a common piece of stock and being perforated for free air flow, the other panel end comprising a separate piece having attachment flanges, and means securing the attachment flanges to the sides, the other panel end overlying the control panel.

According to still further features of the invention, a new and improved combination has been provided which includes a cover structure having sides, the sides having a series of parallel straps with the straps attached at opposite ends with the sides, the straps being positioned below upper ends of the sides, a water pan supported on the straps, and a closure lid pivotally mounted on one of the sides and being swingable into and out of overlying relation with respect to another of the sides to allow the pan to be uncovered for filling of the pan.

According to still further features of our invention we have provided a new and improved method of manufacturing a radiator cover comprising the steps of blanking three sides of a cover from a flat length of cold rolled steel having a thickness in the range of 0.033"–0.038" while contemporaneously perforating one side of the same, then bending selected areas to form a U-shaped cover blank with parallel sides and a flat end member joining the sides at its opposite ends, and with the opposite end of the U-shaped blank being open, turning flange areas of the U-shaped cover blank to provide converging snap fitting bottom ends to the sides, bending flanges on upper ends of the sides and the end member of the cover blank and securing the thus formed flanges in assembly with said blank, attaching a series of parallel hanger straps between the upper end of the sides in rigid assembly therewith, forming a lid and securing the lid in pivoting assembly with one of the parallel sides to provide a closure for an upper end of the U-shaped cover blank, forming an end closure for closing only an upper portion of the open end of the U-shaped cover blank, and securing the end closure in unitary assembly with the parallel sides.

Other objects and features of the present invention will be more fully apparent when viewed from the accompanying drawings illustrating a single embodiment and in which:

FIG. 1 is a perspective view of a combination portable oil filled electric radiator structure and a radiator cover structure mounted thereon embodying important features of our invention;

FIG. 2 is an end view partially in section of the combination shown in FIG. 1 which illustrates additional features of our invention;

FIG. 3 is an enlarged vertical section taken substantially on the line III—III looking in the direction indicated by the arrows as seen in FIG. 2;

Figure 4:
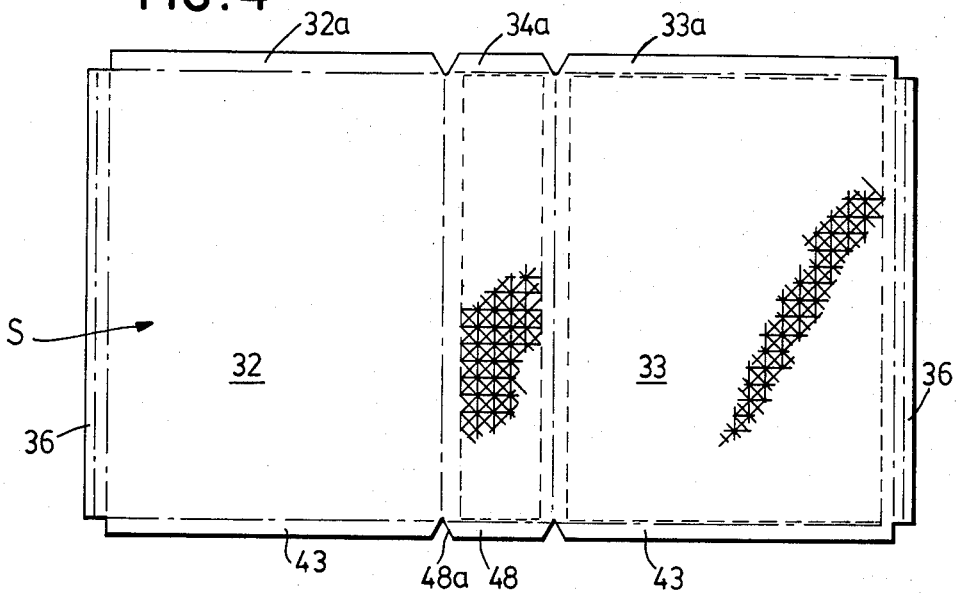
FIG. 4 is a top plan view of a blank for forming three sides of our ventilated cover structure.

The present invention relates to a combination that comprises an oil filled electric radiator structure 10. The structure has a supporting frame structure 11 mounted on castors 12 for supporting the same. An oil filled electric radiator 15 is mounted in supported assembly upon the frame structure 11. Clamps 16 are provided for securing the radiator 15 to the frame structure 11. As will be seen in FIGS. 2 and 3, the clamps 16 each includes a generally U-shaped clamp bolt 17 having one free end 18 engaged beneath the associated frame structure 11 and extended upwardly and around a radiator connecting section 15*a*. An opposite threaded free bolt end 19 extends beneath the frame structure 11 and wing nuts 20 are provided for securing the free end of the bolt 19 in secured assembly to thereby fixedly mount the radiator 15 on the frame structure 11. As will be seen in FIG. 3, the frame structure has a pair of the clamps 16 with one of the clamps associated with each one of the individual frame structures 11.

It will be further observed from FIG. 3 that the radiator 15 has spaced radiator fins 21—21 which are formed in a more or less conventional manner on the radiator. It will further be observed that the frame structure 11 includes a pair of peripherally flanged flat frame members 22 with its side flanges indicated at 23. The member 22 has a width such that it can fit between a pair of the adjacent fins 21 in snug abutment thereagainst and so that the clamp 16 can maintain the engagement between the member 22 with the fins 21—21. This relationship insures that the frame members 15 will be maintained in fixed assembly with the radiator 15. It will further be noted that the castors 12 are suitably mounted on opposite ends of the frame member 22. To this extent, the castors 12 each have a castor rod 12*a* which extends through the member 22 and an enlarged rod head 12*b* assists in maintaining the castor rod 12*a* in assembly with the supporting frame structure 11.

It will further be observed that the radiator 15 has a radiator control offset end panel 25 at one end. This panel includes a thermostatic heat control 26 and an On/Off switch 27 to assist in the operation of the oil filled electric radiator 15.

Figure 5:
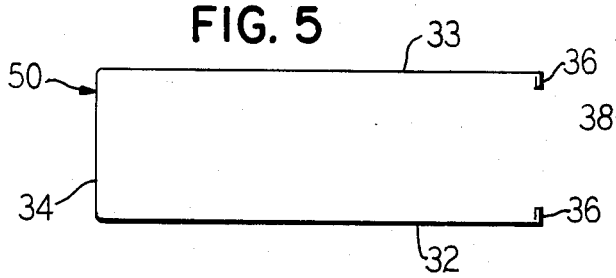
FIG. 5 is an end profile view of the blank shown in FIG. 4 only in a U-shaped folded form.

The combination includes not only the oil filled electric radiator structure 10, but it also includes a cover structure 30. As will be seen from the drawings, the cover structure is illustrated in all Figures and its method of manufacture is particularly shown in FIGS. 4–10. The cover structure 30 possesses a cover 31 having opposite sides 32 and 33 and opposite ends or end members 34 and 35. It will be appreciated that the cover structure 30 is preferably comprised of sheet metal of a type that lends itself to being formed in punch and brake press operations from sheet stock such as is shown in FIGS. 4 and 5. In the initial forming operation, a sheet of preferably 20# gauge cold rolled steel, indicated at S, is cut to shape as shown in FIG. 4 in a punch press operation. Then the sheet S is placed into a brake press and bent to shape in a staged series of operation to form a U-shaped cover blank 50 as shown in FIGS. 5–9, inclusive. The blank 50, in its formed state includes the opposite sides 32 and 33 and the end member 34. It will further be seen that the blank 50 also has C-shaped edges 36—36 formed on its free ends to enable the opposite end or end member 35 to be assembled therewith. The end or end member 35 also has C-shaped edges 37—37 formed thereon and the edges 36 and 37 are so shaped so that they can be slidingly engaged together to thereby enable the end member 35 to be assembled with the U-shaped blank 50. The end member 35 is of a reduced vertical dimension so that when it is in assembly with the U-shaped blank 50, the end member 35 can be slightly spaced above the radiator control or offset end panel 25 of the radiator structure 10. The end member or panel 35 has an upper flange 35*a* which is disposed at right angles to the face of the panel 35 and which is engaged on top of side panel flanges 32*a* and 33*a*, respectively, as seen in FIG. 9. The flange 35*a* is welded at 38—38 to the flanges 32*a* and 33*a*, respectively, as seen in FIG. 9 thereby fixing the position of the panel or end member 35 with relation to the sides 32 and 33.

Figure 6:
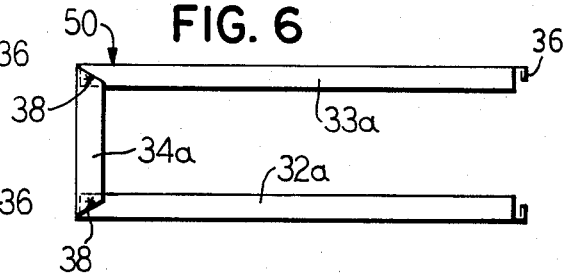
FIG. 6 is an end profile view similar to FIG. 5 only showing the manner in which flanges are folded and welded on the folded blank to rigidify the same.
Figure 7:
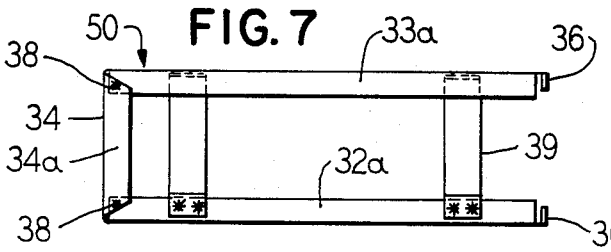
FIG. 7 is a top plan view similar to FIG. 6 only with straps installed for mounting a water pan.

It will further be seen that end member 34 also has its right angular flange 34*a* positioned on top of the side flanges 32*a* and 33*a* and that the flanges are welded together as indicated at 38 in FIGS. 6 and 7.

The cover structure 30 has a pair of identically constructed pan supporting straps 39—39 as seen in FIG. 1. These straps are provided with flanges 39*a*—39*a* which are welded at 44—44 to side flange 32*a*. The straps further have upright strap legs 39*b*—39*b* which are welded to the side 33 thereby providing a firm support for supporting a steel water pan 40 (FIG. 2) thereon.

Also provided on the cover structure 30 is a cold rolled steel lid 41 which is hinged at 42 to the side 33 thereby providing a closure for the upper open end of the cover structure 30. It will be seen that the lid 41 has a three-sided lid flange 41*a* that laps over the cover for concealing the welded flanges 32*a*, 33*a*, 34*a*, 35*a*, and the strap hanger or hanger flanges 39*a*—39*a* thus giving the cover structure 30 a smooth-lined appearance.

In order to allow for air flow through the cover structure, the sides 32 and 33 and the end member 34 are all provided with punch-out perforations 45 as seen in FIG. 1. The side member 33 and the end 35 are imperforated. It will be observed from a study of FIGS. 2 and 3 and the arrow lines, as shown, the manner in which air can flow over the heated radiator 15 and then out through the perforations 45 into the room area to be heated. It will be observed that the cool air flows into the bottom area of the radiator 15 and then moves upwardly and is warmed by the radiator and then is exited outwardly of the radiator structure through the ventilated or perforated cover structure 10.

According to important features of our invention, we have provided the sides 32 and 33 with resiliently yieldable confronting converging bottom ends or flanges 43—43 which angularly extend beneath the radiator on its opposite sides (FIG. 2) for holding the cover 31 and its sides 32 and 33 in snug assembly with the radiator and its frame 11 and with the bottom ends 43—43 also bodily supporting the cover 31 on the frame structure 11. When the cover structure 30 is assembled with the radiator structure 15, the converging ends 43—43 are moved from an overhead position with respect to the radiator structure downwardly along the sides 32—32. Since the ends 43—43 are resiliently yieldable, they are caused to be sprung apart as they are moved vertically downwardly along the fin edges 21 until they are positioned beneath the radiator 15 as seen in FIG. 2. When the cover structure 30 is in proper position, the yieldable confronting converging bottom ends 43—43 rest upon the frame structure 11 in supported engagement thereagainst thereby transmitting the load of the cover structure 30 thereto and to the castors 12. In order to remove the cover structure 30 from the radiator structure 15, the cover 31 can be caused to be moved vertically upwardly and the yieldable confronting converging bottom ends 43—43 are disengaged from the frame structure 11 and from the underneath side of the radiator structure 15 and the ends 43—43 are progressively moved along the fins 21 into a disengaged position whereby the cover structure 31 can be lifted off of the radiator structure 15.

It will further be appreciated that the end member 34 is provided with a bottom end or flange 48 that is angled inwardly at an angle complimentary to the angle of inclanation of the flanges 43—43. The bottom end or flange 48*a* does not itself rest upon the frame member and from a consideration of FIG. 8 it will be seen that its opposite edges 48*a*—48*a* are punched and formed so as to be free of the ends or flanges 43—43 thereby allowing the flanges 43—43 to move freely and independently of the flange 48.

In connection with the manufacture of the cover structure 30 it will be appreciated that according to features of the invention that it is preferred that 20# gauge cold rolled steel is preferably used and that it may have a thickness in the range of 0.033"-0.038". It is important that cold rolled steel of this character be used in order to permit the ends or flanges 43—43 to resiliently yield as they are engaged with the radiator fins and so that these ends or flanges 43—43 can be snugly engaged beneath the radiator structure and rest on the frame 11 to also carry the load of the cover structure on the frame 11.

Figure 8:
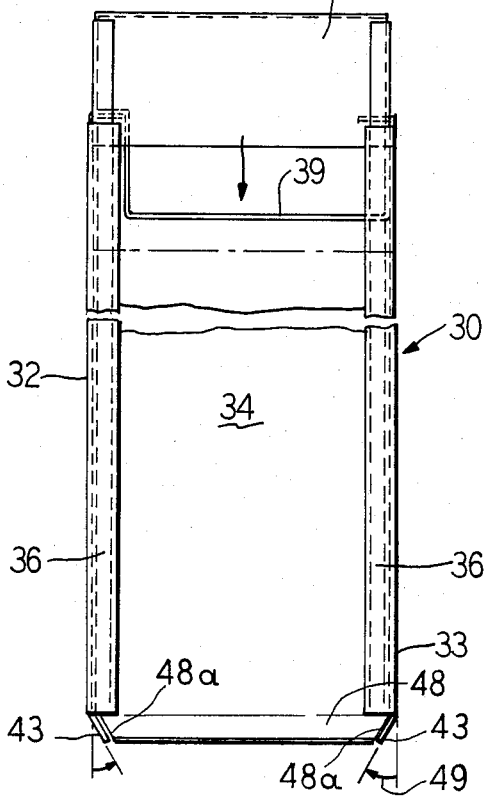
FIG. 8 is an end view of the partially formed cover structure shown in FIG. 7 only with a lid illustrated as being mounted thereon for covering the pan.
Figure 9:
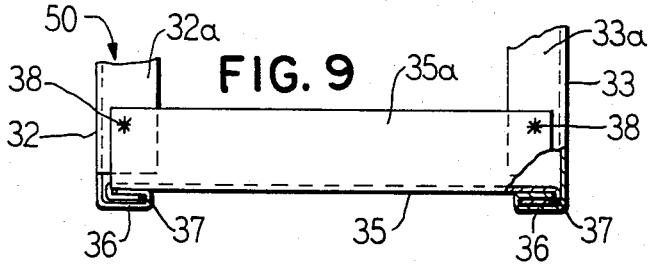
FIG. 9 is an enlarged fragmentary plan view showing the manner in which an end closure is fastened on the partially formed U-shaped cover blank illustrated in FIGS. 5–8, inclusive.
Figure 10:
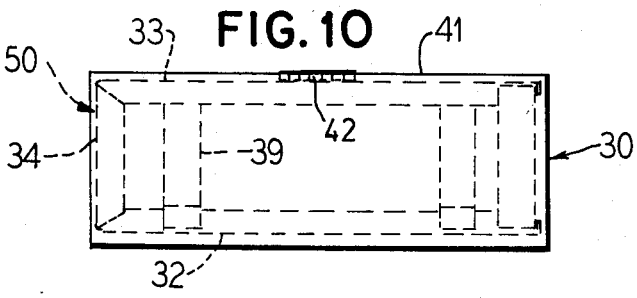
FIG. 10 is a top plan view of the completed cover structure as seen in FIGS. 1 and 2.

It will be appreciated that the shape of the radiator fins can be varied and where varied the angular relationship indicated at 49 in FIG. 8 can also be varied to enable the cover structure to be adopted for use with different types of radiator fin structure. It is presently believed that if the angular relationship of the ends or flanges 43—43 are maintained in the range of 39° to 50° with respect to the associated sides 32 or 33 that optimum results can be obtained. With one type of radiator fin structure, it has been found that it is desired to employ a 39°-40° angle for the end or flange 43. In another type of fin type radiator, it has been found more desirable to use an end or flange 43 having an angular relationship of 49°-50° relative to the associated sides 32 or 33.

In the assembly of the components comprising the cover structure 30 which embodies features of our invention, it will be appreciated that some variance may occur with respect to the exact order that must be followed with respect to the steps of manufacture of the radiator cover 30. According to one preferred method, the radiator cover can be manufactured by blanking three sides of the cover 30 from a flat length of metallic sheet stock while contemporaneously perforating the same and bending selected areas forming a U-shaped cover blank with parallel sides and a flat end member joining the sides at its opposite ends as is seen in FIGS. 4 and 5. Thereafter the various flanges on the sides can be folded as previously described and the C-shaped edges 36—36 can be formed. It will be understood that the end member 35 is formed in a separate manufacturing operation with C-shaped edges 37 which are so constructed to be interengageable with the edges 36 to allow these components to be interengaged in sliding relation as shown in FIG. 9. The end panel flange 35*a* is then welded at 38 to the flanges 32*a* and 33*a* on the sides 32 and 33 as previously described.

As is seen in FIG. 4, the confronting converging bottom ends can be initially formed in the blanking operation on a brake press so that when the sides 32 and 33 are caused to be positioned in the manner shown in FIG. 5, the converging bottom ends can then be correctly positioned on bottom ends of the sides 32 and 33 as is ultimately illustrated in FIG. 8.

It will further be appreciated that in the preferred embodiment, the straps 39 are independently formed and attached after the welds are formed at 38 by further welding operation which in turn welds the straps to the side flanges 32*a* and 33*a* as indicated at 44. The lid is independently formed and secured by the hinge 42 to the cover 30 as shown in FIGS. 1 and 2. As a final step, the pan is independently formed and mounted on the straps as is shown in FIGS. 1 and 2.

We claim:

1. In combination, an oil filled electric radiator supporting structure having a supporting frame structure including castors supporting the same, an oil filled electric radiator mounted in supported assembly on the frame structure, means securing the radiator to said frame structrue, a radiator control panel at one end of said radiator, and a radiator cover structure mounted on the radiator and fitted about said control panel, the cover structure having a cover comprised of cold rolled steel having a thickness in the range of 0.033"-0.038", the cover including downwardly extending parallel sides on opposite sides of the radiator for permitting air flow to circulate to and from the radiator, one of said sides being perforated, the sides having yieldable confronting converging bottom ends extended beneath said radiator on its opposite sides, the bottom ends being spaced apart a distance narrower than the width of the radiator so as to yieldably engage against the sides of the radiator for holding the cover and its sides in snug assembly with the radiator and its frame structure and with said bottom ends of the sides also bodily engaged against said frame structure to support the cover on said frame structure.

2. The combination of claim 1 further characterized by said cover structure having opposite panel ends, one of said panel ends and said sides being formed from a common piece of stock and being perforated for free air flow, the other panel end comprising a separate piece having attachment flanges, and means securing said attachment flanges to said sides, the other panel end positioned adjacent said control panel.

3. The combination of claim 2 further characterized by the sides having end flanges disposed in a common vertical plane but spaced and positioned in edgewise relation to the opposite sides of said control panel.

4. The combination of claim 1 further characterized by the converging bottom ends each being disposed at an angle in the range of 39°–50° relative to the associated side.

5. The combination of claim 4 further characterized by the cover having a flat end member connected to said parallel sides, the flat end member having an inwardly angled bottom end disposed at the same angle as said converging ends of the sides.

6. The combination of claim 5 further characterized by the converging bottom ends being spaced from opposite edges of said inwardly angled bottom end to permit said converging bottom ends to yieldably move independently of said inwardly angled bottom end.

7. In combination, an oil filled electric radiator supporting structure having a supporting frame structure including castors supporting the same, an oil filled electric radiator mounted in supported assembly on the frame structure, means securing the radiator to said frame structure, a radiator control panel at one end of said radiator, and a radiator cover structure mounted on the radiator and fitted about said control panel, the cover structure having a cover comprised of cold rolled steel having a thickness in the range of 0.033"–0.038", the cover including downwardly extending parallel sides on opposite sides of the radiator for permitting air flow to circulate to and from the radiator, one of said sides being perforated, the sides having yieldable confronting converging bottom ends extended beneath said radiator on its opposite sides, the bottom ends being spaced apart a distance narrower than the width of the radiator so as to yieldably engage against the sides of the radiator for holding the cover and its sides in snug assembly with the radiator and its frame structure and with said bottom ends of the sides also bodily engaged against said frame structure to support the cover on said frame structure, the sides having a series of parallel straps with the straps attached at opposite ends with the sides, the straps being positioned below upper ends of the sides, a water pan supported on the straps, and a lid pivotally mounted on one of said sides and being swingable into and out of overlying relation with respect to another of said sides to allow the pan to be uncovered for filling of the pan.

8. For use with an oil filled electric radiator having a supporting frame structure including castors supporting the same and having a radiator control panel at one end of the radiator, and a cover enclosing the radiator, the improvement wherein said cover comprises cold rolled steel having a thickness in the range of 0.033"–0.038", the cover including downwardly extending parallel sides on opposite sides of the radiator, one side of the cover being perforated for permitting air flow to circulate to and from the radiator, the sides having yieldable confronting converging bottom ends spaced apart a distance less than the width of the radiator for engagement beneath the radiator on its opposite sides for holding the cover and its sides in snug assembly with the radiator and its frame structure and with said bottom ends of the sides also bodily engaged against said radiator to support the cover on said frame structure.

9. The cover of claim 8 having opposite panel ends, one of said panel ends and said sides being formed from a common piece of stock and having a side and said one end perforated for free air flow, the other panel end comprising a separate piece having C-shaped attachment flanges, and means comprising C-shaped side edges engaged with said attachment flanges securing the end panel in assembly with the sides.

10. A method of manufacturing a radiator cover comprising the steps of blanking three sides of a cover from a flat length of cold rolled steel having a thickness in the range of 0.033"–0.038" while contemporaneously perforating one side of the same, then bending selected areas to form a U-shaped cover blank with parallel sides and a flat end member joining the sides at its opposite ends, and with the opposite end of the U-shaped blank being open, turning flange areas of the U-shaped cover blank to provide converging snap fitting bottom ends on the sides, bending flanges on upper ends of the sides and the end member and securing the thus formed flanges in assembly with said blank, attaching a series of parallel hanger straps between the sides in rigid assembly therewith, forming a lid and securing the lid in pivoting assembly with one of the parallel sides to provide a closure for an upper end of the U-shaped cover blank, forming an end closure for closing only an upper portion of the open end of the U-shaped cover blank, and securing the end closure in unitary assembly with the parallel sides.

11. The method of claim 10 further characterized by the converging bottom ends each being disposed at an angle in the range of 39°–50° relative to the associated side.

12. The method of claim 11 further characterized by forming the flat end member with an inwardly angled bottom end disposed at the same angle as said converging ends.

13. The method of claim 12 further characterized by the converging bottom ends of the sides being formed spaced from the inwardly angled bottom end of the flat end member.

* * * * *